United States Patent [19]

Staples et al.

[11] 4,344,296

[45] Aug. 17, 1982

[54] EFFICIENT SECOND STAGE COOLING SYSTEM

[76] Inventors: Jack W. Staples, 655 Keys Rd., Yakima, Wash. 98901; James X. Norris, 507 Harris Ave., Selah, Wash. 98942

[21] Appl. No.: 187,151

[22] Filed: Sep. 15, 1980

Related U.S. Application Data

[63] Continuation of Ser. No. 926,852, Jul. 21, 1978, abandoned.

[51] Int. Cl.[3] ..... F25B 7/00; F25D 17/00

[52] U.S. Cl. ..... 62/175; 62/114; 62/333

[58] Field of Search ..... 165/105, 70; 62/333, 62/175, 201, 127, 219, 114

[56] References Cited

U.S. PATENT DOCUMENTS

| | | | |
|---|---|---|---|
| 1,996,441 | 4/1935 | Smith | 62/333 X |
| 2,033,228 | 3/1936 | Buffington | 62/114 X |
| 2,309,296 | 1/1943 | Bentley | 184/104 |
| 3,537,513 | 11/1976 | Austin | 165/70 |
| 3,552,136 | 1/1971 | Cook | 62/139 |
| 3,564,727 | 2/1971 | Fraser | 34/92 |
| 4,138,856 | 2/1979 | Orlowski | 62/181 |

*Primary Examiner*—William E. Wayner

*Attorney, Agent, or Firm*—Cole, Jensen & Puntigam

[57] ABSTRACT

A two-stage refrigeration system including a primary cooling circuit which may be of the mechanical, vapor-compression type and a secondary closed system which is limited to an evaporator, located in the product storage area, a condenser and the necessary interconnecting conduits. The two circuits are operatively linked by a heat exchanger located outside the product storage area. The heat exchanger serves as the evaporator of the primary, caustic refrigerant system, and as the condenser of the secondary, relatively safe, volatile refrigerant system. Means are provided to prevent the refrigerant of the primary circuit from entering the secondary circuit in the event of heat exchange leakage. The heat exchanger design as well as the primary circuit control permits a rapid response to changes in temperature in the product storage area without requirement of controls on the secondary side of the system.

7 Claims, 2 Drawing Figures

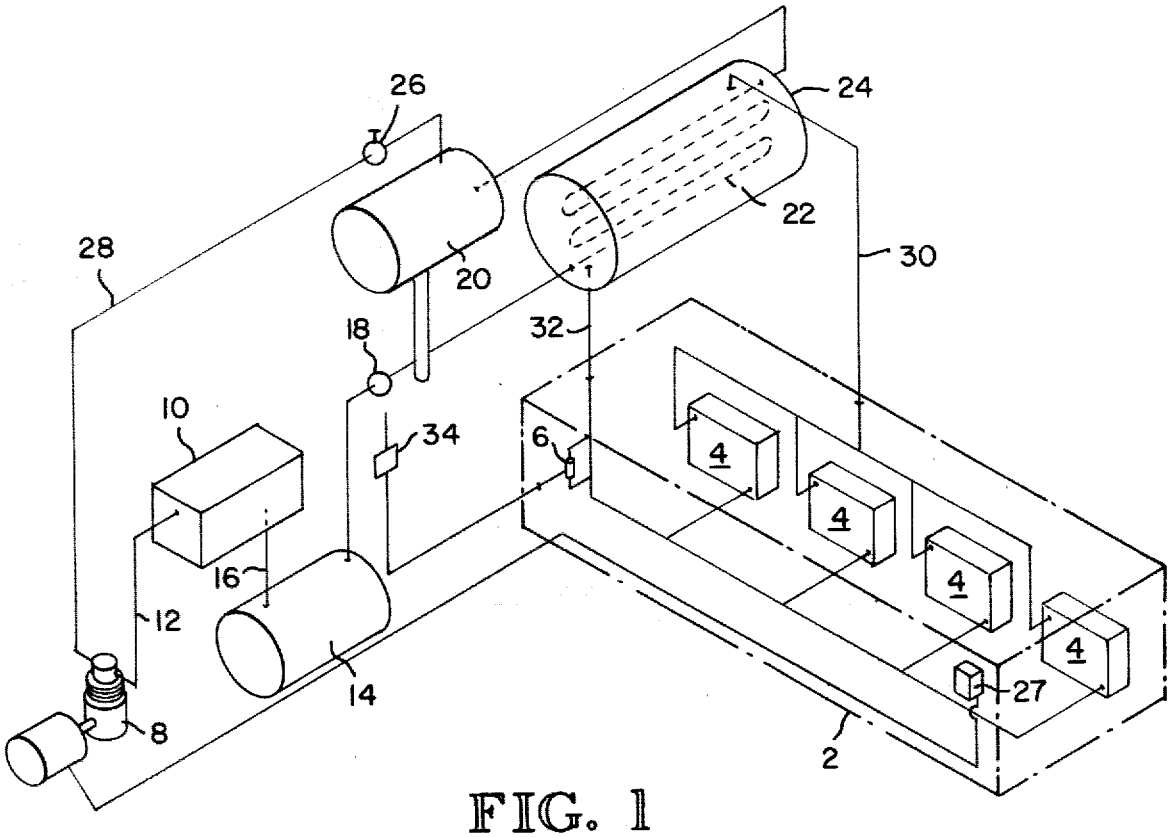
FIG. 1
FIG. 2
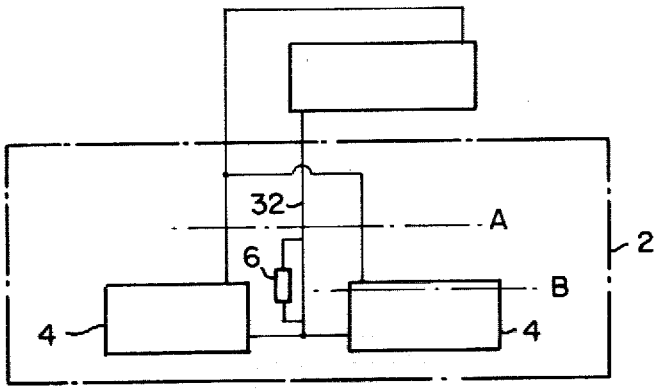

EFFICIENT SECOND STAGE COOLING SYSTEM

This is a continuation of application Ser. No. 926,852, filed July 21, 1978, now abandoned.

BACKGROUND OF THE INVENTION

The present invention deals with a two-stage cooling system primarily of the type used in fruit or other food storage systems. One of the primary advantages to using a two-stage system lies in the fact that the primary system may utilize a more efficient, yet caustic, refrigerant within the system and the secondary, closed loop system which extends into the storage area uses a relatively safe refrigerant. If there is a leak within the storage area extensive damage to the food product will not result.

As will be immediately obvious, one of the major concerns with food storage is maintaining a proper temperature within the storage area. Prior art systems, some of which will be described in detail hereinafter, have utilized two-stage systems wherein the control of the temperature within the storage area is regulated by a control system within the secondary system.

One of the problems with the two-stage cooling system for food products, although enabling the food product to be primarily separated from the caustic refrigerant, includes the possibility of leakage within the system thus allowing the caustic primary refrigerant to enter into the secondary system, greatly endangering the food products. The secondary system may well not be of a material resistant to the caustic, primary refrigerant.

Yet another problem with the utilization of a two-stage system wherein the second stage is not sufficiently protected from the caustic refrigerant of the primary stage lies in the fact that the tubing or coils as well as other portions of the system must be of a material which will withstand the caustic material in order to prevent corrosion and leakage, thus greatly increasing the cost.

Prior art references known to the inventor dealing with a two-stage refrigeration system include U.S. Pat. No. 1,996,441 granted to Smith on Apr. 2, 1935 which discloses a two or more stage system having substantially uniform pressure within the circuits and control means within the secondary system.

U.S. Pat. No. 2,022,764 granted to Gibson et al. on Dec. 3, 1935 deals with a two-stage refrigeration apparatus wherein the temperature control is depended upon the pressure and temperature within the secondary loop.

U.S. Pat. No. 2,986,903 Cocher et al. deals with a particular heat exchanger for use in a system which includes two-stage refrigeration.

U.S. Pat. No. 3,363,430 granted to White on Jan. 16, 1968 deals with a two-stage condensing loop utilizing different refrigerants but providing no indication as to the means of control of temperature.

U.S. Pat. No. 3,683,640 granted to Eber discloses a refrigeration apparatus having a secondary refrigeration system.

U.S. Pat. No. 3,985,182 granted to Hara et al. discloses a heat transfer device in which there is provided a closed loop consisting of a descending flow tube for liquid and an ascending flow tube for water.

U.S. Pat. No. 4,025,326 granted to Leonard discloses a refrigeration unit having a closed secondary system connected in a heat exchange relationship with the primary system. In this system, the secondary system is a heating rather than a cooling system.

With the above known prior art and problems in mind, it is an object of the present invention to provide a two-stage cooling system wherein the refrigerant of the second system is contained within a closed loop utilizing a far less caustic refrigerant and thus permitting the utilization of less expensive conduits and the like.

It is another object of the present invention to provide a two-stage cooling system wherein the heat transfer between the two systems is efficient enough that the control for the temperature is located only in the primary system and provides adequate sensitivity in both systems.

It is still another object of the present invention to provide a two-stage cooling system wherein there is a differential in pressure between the primary caustic system and the secondary inert system whereby if there is a leak the flow would be from the inert to the caustic thereby preventing the introduction of caustic material into the secondary system.

Yet another object of the present invention is to provide a warning system which will prevent further operation upon the happening of an endangering condition.

BRIEF DESCRIPTION OF THE DRAWINGS

FIG. 1 is a schematic view of the two-stage cooling system in accordance with the present invention.

FIG. 2 is an enlarged schematic view showing the fail safe controls in greater detail.

DETAILED DESCRIPTION OF THE DRAWINGS

As seen in FIG. 1, the storage area 2 is generally outlined in schematic and will contain in the interior thereof in addition to food storage facilities one or more evaporators 4. The interconnection between the evaporators and the controls will be described in greater detail hereinafter, however, it is important to note at this point that the only portion of the system which is located within the storage area i.e. the area which will contain the food product, are the evaporators 4, the necessary conduits, and as explained hereinafter, a low level sensor 6.

Mounted or located exterior of the storage area are the compressor 8, the condenser 10, being interconnected by means of conduit 12 as well as a refrigerant reservoir 14 interconnected with the condenser by means of conduit 16 which also serves as a drain line. An expansion device 18 feeds liquid refrigerant to a low pressure accumulator 20 which maintains an adequate primary refrigerant level in the primary evaporator 22. The primary evaporator 22 is located within the heat exchanger 24 which, as noted above, is located outside the product storage area.

A primary low pressure control device 26 maintains the desired refrigerant temperature in the accumulator and primary evaporator responsive to conditions within the storage room 2. The control device 27 may, for example, measure and be responsive to the temperature of the air within the storage room. The low pressure primary vapor is then returned to the compressor through conduit 28.

The secondary circuit i.e. that which is utilized to cool the storage area consists of one or more evaporators 4 located within the storage area and filled with a secondary, volatile refrigerant to a level which is sufficiently above the top of the evaporator means to insure a flooded operation under all load conditions. A vapor return line 30 penetrates the storage enclosure and transmits the refrigerant to a condenser which consists of the external surfaces of the primary evaporator coil 22. It is to be noted that the primary evaporator coil is contained by the heat exchanger 24 i.e. located within the shell or casing of the heat exchanger. A drain line 32 returns the liquid to the evaporators 4.

Referring now to FIG. 2, some of the features which distinguish the present invention from the prior art are more easily seen. A low liquid float 6 installed in the return line or condenser drain 32 at a level actuates an alarm and circuit breaker device 34 (see FIG. 1). The actuation of circuit breaker 34 in a manner well known in the art discontinues the flow of the primary refrigerant through the expansion device 18. The low level float also sounds an alarm or lights a warning light in the event of loss of the secondary refrigerant below the predetermined level B.

It is important to note that the selection of the refrigerant is such that the vapor pressure in the secondary circuit is higher, under all conditions then the vapor pressure in the primary circuit. For example, R-22 could be used in the secondary circuit and ammonia in the primary circuit.

It is to be noted from the drawing that the level B is situated below level A, which is the flood level, sufficiently above the bottom of the evaporators 4. The secondary vapor pressure is maintained above the primary vapor pressure until the primary refrigerant is depleted from the evaporator and the accumulator.

The sizing of the heat exchanger 24 assures that a small temperature differential, preferably less than 10% of the total temperature difference between the primary evaporator to the room temperature, is maintained between the primary and secondary refrigerant such that the refrigerant temperature in the secondary circuit is highly responsive to changes in the primary refrigerant temperature. The primary circuit is controlled by the temperature conditions in the storage room such that no control devices are utilized in the secondary circuit.

Thus, as can be seen, the present invention provides a simple, less expensive and far safer means for refrigerating fruits or other items kept within a food storage area.

What is claimed is:

1. A two stage cooling system for use in conjunction with a closed food storage room, comprising:

a first or primary cooling stage located entirely outside the room to be cooled and including a compressor, condenser and evaporator, all functionally interconnected, said first stage containing a caustic but efficient refrigerant at a predetermined pressure, temperature control means for the first stage, said control means located within the room such that the control of the primary circuit is responsive solely to the condition created by the secondary circuit, a second cooling stage having its condenser and in thermal communication with the evaporator of the first stage within the heat exchanger, said second stage having at least one evaporator within the room and containing an inert refrigerant at a pressure higher than that of the primary stage whereby any leakage within the heat exchanger will result in a flow of refrigerant from the second to the first stage, thereby preventing any of the refrigerant from the first stage from entering the food storage room, enabling use of the caustic refrigerant in the first stage and any leakage within the room itself will not be harmful to the product.

2. A two-stage cooling system as in claim 1, wherein the second stage includes a refrigerant level detector which operates to turn off the primary circuit in the event of a reduction in the volume of the secondary refrigerant.

3. A two-stage cooling system as in claim 1, wherein the exterior surface of the evaporator coil for the primary stage serves as the condenser for the secondary stage.

4. A two-stage cooling system as in claim 1, wherein the second stage operates in a flooded condition.

5. A two-stage cooling system as in claim 2, wherein the refrigerant level determination is by a float.

6. A two-stage cooling system as in claim 1, wherein the second stage is limited to an evaporator and a condenser with the necessary interconnecting conduits.

7. A two-stage cooling system as in claim 1, wherein the relative sizes of the condenser and the evaporator within the heat exchanger, such that the temperature differential between the primary and secondary refrigerant is very small, thus making both systems interresponsive.

* * * * *